US005555638A

United States Patent [19]

Lehosvuo et al.

[11] Patent Number: 5,555,638

[45] Date of Patent: Sep. 17, 1996

[54] METHOD FOR CONTACT DRYING A PAPER WEB AND A DRYER SECTION OF A PAPER MACHINE

[75] Inventors: Risto Lehosvuo, Säynätsalo; Allan Liedes, Palokka; Pekka Matilainen, Vaajakoski, all of Finland

[73] Assignee: Valmet Corporation, Helsinki, Finland

[21] Appl. No.: 410,076

[22] Filed: Mar. 24, 1995

[30] Foreign Application Priority Data

Mar. 29, 1994 [FI] Finland ..... 941449

[51] Int. Cl.[6] ..... F26B 3/00; F26B 13/08

[52] U.S. Cl. ..... 34/117; 34/116

[58] Field of Search ..... 34/114, 116, 117

[56] References Cited

U.S. PATENT DOCUMENTS

| | | | |
|---|---|---|---|
| 4,416,070 | 11/1983 | Vedenpa et al. | 34/117 |
| 4,441,263 | 4/1984 | Vedenpaa . | |
| 4,474,643 | 10/1984 | Lindblad | 34/116 |
| 4,502,236 | 3/1985 | Adrian . | |
| 4,516,330 | 5/1985 | Eskelinen et al. . | |
| 4,661,198 | 4/1987 | Simmonds, Jr. et al. . | |
| 4,905,380 | 3/1990 | Eskelinen et al. . | |
| 5,022,163 | 6/1991 | Ilvespaa et al. . | |
| 5,232,554 | 8/1993 | Kotitschke | 34/117 |
| 5,269,074 | 12/1993 | Sims et al. | 34/117 |
| 5,465,505 | 11/1995 | Kertulla | 34/117 |

FOREIGN PATENT DOCUMENTS

| | | |
|---|---|---|
| 80103 | 5/1988 | Finland . |
| 934367 | 10/1993 | Finland . |
| 940749 | 2/1994 | Finland . |

*Primary Examiner*—James Larson

*Attorney, Agent, or Firm*—Steinberg, Raskin & Davidson P.C.

[57] ABSTRACT

A method for contact drying a paper web, wherein the paper web is dried by heated smooth-faced drying cylinders by passing the web through successively arranged so-called normal groups with single-wire draw in which drying cylinders are situated in a first row and reversing suction cylinders or equivalent suction rolls are situated in a second row. Thereafter, the web is dried by passing it through a hybrid dryer group which hybrid dryer group consists of a normal portion with single-wire draw and a portion with twin-wire draw, one of the wires in the twin-wire portion constituting the wire of the portion with single-wire draw whereas the other wire in the twin-wire portion is a separate wire. The invention also relates to a dryer section of a paper machine wherein the initial part includes successively arranged so-called normal groups with single-wire draw after which one hybrid dryer group is provided, in which there is a portion with single-wire draw and a portion with twin-wire draw. In the hybrid group, one row includes drying cylinders over which the wire of the single-wire draw runs, and the other row includes reversing cylinders, suction rolls or equivalent, and drying cylinders. A separate wire runs over the drying cylinders in this row.

27 Claims, 5 Drawing Sheets

METHOD FOR CONTACT DRYING A PAPER WEB AND A DRYER SECTION OF A PAPER MACHINE

BACKGROUND OF THE INVENTION

The present invention relates to a method for contact drying a paper web wherein the paper web is dried by means of heated smooth-faced drying cylinders. The web is carried through several successively arranged so-called normal groups with single-wire draw in which the drying cylinders are situated in an upper row and reversing suction cylinders or equivalent suction rolls are situated in a lower row below the upper row of drying cylinders. In the method, after the press section of the paper machine, the paper web is dried initially in a number of successively arranged groups with single-wire draw by carrying the web on a drying wire in each group which presses the web against the heated faces of the drying cylinders in that group. In each group with single-wire draw, the paper web is passed on support of the same drying wire from one drying cylinder to another over a reversing suction cylinder or roll. When the paper web is situated at the side of the outside curve of the reversing suction cylinder or roll, the web is kept on the drying wire by means of a difference in pressure against the effect of centrifugal forces.

Further, the present invention relates to a dryer section of a paper machine having an initial part including several successively arranged so-called normal groups with single-wire draw in which the drying cylinders are situated in an upper row and reversing suction cylinders or equivalent suction rolls are situated in a lower row below the upper row of drying cylinders. Between the normal groups, the paper web to be dried has closed draws over the group gaps. The reversing suction cylinders or equivalent suction rolls are arranged so that at least the turning sectors for the drying wire over the cylinders or rolls are subjected to a vacuum.

In web formation and processing applications, the highest web speed in paper machines is currently of an order of 25 meters per second. However, in the near future, it is anticipated that a speed range of from about 25 m/s to about 40 m/s is likely to be used. With the present highest running speeds and with the increasing running speeds in the future, in particular the dryer section has become, and will increasingly be, the bottle-neck in view of the runnability of a paper machine.

In addition, the requirements of quality imposed on the paper produced, in particular on fine paper and copying paper, are even now quite strict and are becoming ever stricter. Particularly high requirements are imposed on the symmetry of the paper in the z-direction and on the surface properties of both faces of the paper as well as on the stability of the structure of the paper as it is heated abruptly in a copying or printing process. These quality requirements imposed on a paper product impose particularly high requirements on the dryer section of a paper machine, and with increasing running speeds it is more and more difficult to meet these requirements.

In a manner known from the prior art, in multi-cylinder dryers of paper machines, twin-wire draw and/or single-wire draw is/are employed. In twin-wire draw, the groups of drying cylinders include two wires which press the web, one from above and the other one from below, against the heated cylinder faces. Between the rows of drying cylinders, which are usually horizontal rows, the web has free and unsupported draws, which are susceptible of fluttering resulting in web breaks. For this reason, in recent years, increasing use has been made of the single-wire draw in which each group of drying cylinders has only a single drying wire on whose support the web runs through the entire group so that the drying wire presses the web on the drying cylinders against the heated cylinder faces, whereas, on the reversing cylinders between the drying cylinders, the web remains at the side of the outside curve. Thus, in single-wire draw, the drying cylinders are situated outside the wire loop and the reversing cylinders are situated inside the wire loop.

In the prior art groups with single-wire draw, normal drying groups are used in which the heated drying cylinders are placed in an upper row and the reversing cylinders are placed in a lower row below the upper row of drying cylinder. The upper and lower rows are generally horizontal and parallel to one another. Further, as known from the prior art, besides the normal drying groups, dryer sections have also included so-called inverted groups with single-wire draw in which the heated drying cylinders are placed in the lower row and the reversing suction cylinders or rolls in the upper row, i.e., in an inverted formation. The principal objective of this arrangement is to dry the web symmetrically from both sides.

In dryer sections that comprise inverted and normal drying groups with single-wire draw, various problems have occurred, for which problems the present invention suggests novel and efficient solutions. These problems include the large length of the dryer section, which increases the costs of the dryer section and of the machine hall. Problems have also been encountered in the runnability of the dryer section and in the threading of the web. Problems also arise from differences in the speeds of different wires, as well as those problems related to the control of transverse shrinkage of the web. In inverted drying groups, in the event of breaks, a further problem consists of the difficulty in removing breaks because inverted groups are not self-cleaning by the force of gravity. Generally, these problems tend to become worse as the running speed of the paper machine becomes higher.

On the other hand, when dryer sections are used that include normal drying groups with single-wire draw alone, problems arise from the curling of the paper web, which results from the more intensive drying of the paper web from one side. For this reason, the inverted drying groups mentioned above have been used in dryer sections in spite of the problems described above. In the prior art arrangements, inverted groups have not been used in the initial part of the dryer section, because of the risk of web breaks, i.e., the dry solids content of the web at the initial part is not high enough to enable the Web to be passed in open draws existing in a twin-wire draw, but are primarily used toward the end of the dryer section. Frequently, besides the normal groups, just one inverted drying group has been employed.

In prior art dryer sections in which exclusively groups with single-wire draw are used, in the last wire groups, considerable wear of the drying fabrics has occurred, in particular in the manufacture of fine papers with a high content of fillers, and even more so if calcium carbonate has been used as a filler. Thus, the present invention is directed to reducing this problem which occurs in the drying groups driven by the drying wire because of the considerable thickness of the drying wire. The differences in speed mentioned above, together with a restricted drying shrinkage, cause web breaks in the last groups when exclusively single-wire draw has been used. This problem is emphasized further if, in the groups with single-wire draw, small-diameter suction rolls proper are used that are provided with an inside suction box. In order to eliminate this problem, in some machines, it has been even necessary to open some group gaps and to lower the level of negative pressure in the suction rolls. Problems similar or corresponding to those described above are encountered, e.g., in the dryer section described in the U.S. Pat. No. 5,269,074 (assigned to Beloit Corp.), wherein, in the groups with single-wire draw, normal suction rolls are used which have very small diameters and which are provided with inside suction boxes. Moreover, in this U.S. patent, a dryer section is described in which the last group is a single group with twin-wire draw, in which there are two rows of drying cylinders placed one row above the other, whereby the web has free draws between the two rows. A dryer section similar to that mentioned above is also described in the assignee's Finnish Patent Application No. 934367 (corresponding to the assignee's U.S. patent application Ser. No. 08/213,148, the specification of which is hereby incorporated by reference herein).

In the above-mentioned U.S. patent and Finnish patent application, it is indicated that the tensile strength of a paper web is increased substantially when its dry solids content becomes higher, so that it has been considered that the group with twin-wire draw should be placed preferably expressly as the last group in the dryer section in whose area the dry solids content of the web is at the maximum, and so is the tensile strength at the maximum in view of elimination of the problems of runnability produced by the free draws of the web. Then, consideration has, however, not been given to the fact that the susceptibility of breaks at the free draws of the web does not depend on the tensile strength of the web alone, but also on the breaking strength (tensile-energy absorption) and the tear strength in particular in respect of breaks and wrinkles starting in the lateral areas of the web. For this field of problem, a solution has been suggested in the assignee's Finnish Patent Application No. 940749 (filed on Feb. 17, 1994). In this Finnish patent application, among other things, a dryer section is described in which the second-to-last or penultimate group is a single group with twin-wire draw, in which there are two rows of drying cylinders, one row placed above the other, between which rows the web has free draws.

OBJECTS AND SUMMARY OF THE INVENTION

It is an object of the present invention to further develop the dryer sections described in the above-mentioned Finnish patent applications, in particular so that the control of curling of the paper web can be improved further.

It is another object of the present invention to achieve the above object while, nevertheless, keeping the runnability of the paper machine at least equally good as in the dryer sections as described in the above-mentioned Finnish patent applications and in the above-mentioned U.S. patent, or, in some special cases, even to improve the runnability.

Another object of the present invention is to provide a novel drying method and dryer section in which a final portion of the dryer section is used that has been arranged in such a way that, in the final portion, the paper web is given a possibility and time to relax in the free gaps so that breaks arising from internal strains in the web are eliminated.

It is a further object of the invention to provide a dryer section in which so-called ropeless tail threading can be applied favorably over the entire length of the dryer section in the machine direction, which contributes to making the constructions simpler and the standstill times shorter.

It is still another object of the present invention to provide a dryer section in which inverted groups are not needed at all but which, nevertheless, meets the other requirements that are imposed on the dryer section.

In view of achieving the objects stated above and others, in the method in accordance with the invention, a paper web is passed through several groups with single-wire draw and is dried thereby to a certain dry solids content $k_1$ which is between about 65% and about 85%. After these drying stages, which are carried out exclusively by means of normal groups with single-wire draw, the paper web is dried directly by means of a hybrid dryer group to a dry solids content $k_2$ which is between about 90% and about 100%, which hybrid dryer group comprises a normal portion with single-wire draw and a portion with twin-wire draw. An upper wire in the twin-wire portion is the same wire as in the portion with single-wire draw whereas the lower wire is a separate wire.

In the dryer section in accordance with the invention, after several groups with single-wire draw, one hybrid dryer group is provided in which there is a portion with single-wire draw and a portion with twin-wire draw. In the hybrid group, the upper row comprises drying cylinders over which the wire of the single-wire draw runs, and the lower row comprises reversing cylinders, suction rolls or equivalent, and drying cylinders. A separate wire runs over the drying cylinders in the lower row carrying the web into contact therewith.

In this application, a hybrid dryer group (hybrid group) refers to a group with single-wire draw in which a part has been formed with twin-wire draw, i.e. one and the same drying group in which there is both single-wire draw and, over a portion of the group, twin-wire draw. In a hybrid dryer group, in the portion with twin-wire draw, the upper wire is the same wire as in the single-wire draw, and the lower wire is a second, separate wire.

In according with the invention, of the groups in the final end of the dryer section, at least one group is a so-called hybrid group, in which a portion of a group with single-wire draw has been formed into a group with twin-wire draw. As such, it is favorably possible to employ free draws of the paper web between the rows of cylinders in the group, on which free draws the paper web is allowed to relax. In this manner, tearing of the paper web and resulting web breaks can be substantially eliminated.

Moreover, in accordance with the invention, in the hybrid group, the paper web is dried from both sides, whereby curling of the paper web can be controlled better, which control can be improved further, for example, by regulating the steam pressures in the cylinders in the different rows of cylinders. Further, when hybrid dryer groups in accordance with the present invention are used, owing to the increased drying efficiency, it is possible to make the length of the dryer section up to 5–7 meters shorter than a conventional dryer section without such a hybrid group while maintaining the drying capacity unchanged.

In a dryer section in accordance with the invention, the shrinkage of the web in the cross direction may be increased just slightly in comparison with the situation that the web were dried by means of a dryer section exclusively consisting of groups with single-wire draw, but, especially when a size press or a coating device is used after the dryer section, in the final product no difference can be noticed in this respect that would be detrimental to the invention.

In the arrangement in accordance with the present invention, ropeless tail threading of the web can be applied. With advantageous locations of the cylinders, in a dryer section in accordance with the invention, if necessary, the group gap can be provided with a closed draw which improves the operation of the tail threading further.

Further, in the arrangement in accordance with the present invention, when paper tail cutting is carried out, the tail cutting can be carried out against a supported face, which is considerably easier than tail cutting at a free draw.

In the present invention, by means of a combination of a number of process steps and components that are known in themselves from the prior art, it has been possible to create a dryer section that is more advantageous both in respect of its construction and in respect of its runnability. The paper produced by means of the inventive dryer section having quality properties that meet even high requirements, also in respect of symmetry and dimensional stability.

By means of the area of single-wire draw placed at the end of the portion with twin-wire draw in the hybrid group, it is possible to tighten the paper web inside the portion with twin-wire draw because of the difference in speed of the paper (thickness of the wire). In this manner, fluttering/slackness of the paper web can be reduced in the portion with twin-wire draw.

In the following, the invention will be described in detail with reference to some exemplifying embodiments of the invention schematically illustrated in the figures in the accompanying drawing. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
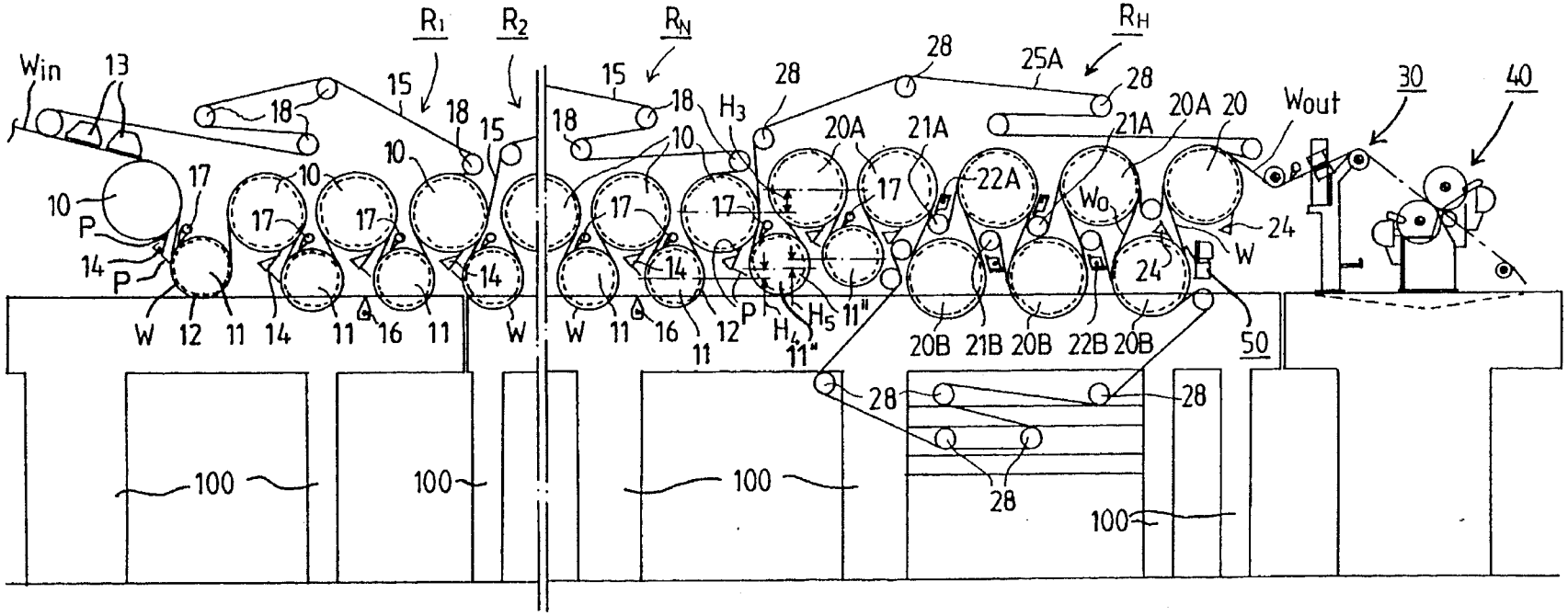
FIG. 1 is a side view of a dryer section in accordance with the invention that makes use of the method of the invention.

Referring to the accompanying drawings wherein the same reference numerals refer to the same elements, as shown in FIGS. 1–4, a paper web $W_{in}$ is passed to a dryer section in accordance with the invention from a press section (not shown) onto a drying wire 15 of the first group with single-wire draw $R_1$. The web is made to adhere to the wire by the effect of the negative pressure produced by suction boxes 13 which are for example suction boxes marketed by the assignee with the trademark "Press-Run blow box". The dryer section comprises N groups with single-wire draw $R_1, R_2, \ldots, R_{N-1}, R_N$. In the group gaps between adjacent groups $R_1, \ldots, R_N$, the web W preferably has closed draws. In a dryer section in accordance with the invention, the number of normal groups $R_1, \ldots, {}_N$ is 3 to 9, preferably N is 5 to 7, and typically N is 6. All the groups with single-wire draw $R_1, \ldots, R_N$ are so-called normal groups, in which steam-heated smooth-faced drying cylinders 10 are placed in the upper horizontal row, and reversing suction cylinders 11 or equivalent suction rolls are placed in the lower horizontal row. A frame part 100 of the dryer section is illustrated only schematically. The last group in the dryer section is a hybrid group $R_H$ in accordance with the invention which will be described in more detail later. Thus, in a dryer section in accordance with the invention, there are no so-called inverted groups with single-wire draw at all, and thus the problems of broke removal or other problems related to such inverted groups do not occur in the inventive dryer section.

Each normal group $R_1, \ldots, R_N$ has a drying wire 15 of its own, which wire is guided by guide rolls 18. The drying wires 15 press the web W to be dried on the drying cylinders 10 against their smooth heated faces, and on the reversing cylinders 11 the web W remains at the side of the outside curve on the outer face of the wire 15. On the turning sectors of the reversing cylinders 11, the web W is kept reliably on support of the wire 15 against the effects of centrifugal forces by the effect of the negative pressure present in the grooved faces 12 of the reversing cylinders 11, whereby transverse shrinkage of the web W is also counteracted. The reversing suction cylinders 11 that are used are preferably suction cylinders marketed by the assignee under the trademark "VAC-ROLU"™, which cylinders have no inside suction boxes and with respect to the details of whose constructions reference is made to the assignee's Finnish Pat. No. 83,680 (corresponding to the assignee's U.S. Pat. No. 5,022,163, the specification of which is hereby incorporated by reference herein). However, it should be emphasized that the scope of the invention also includes dryer sections in which, in the positions of the reversing cylinders 11, ordinary suction rolls provided with an inside suction box are used, also including suction rolls of quite small diameters. Normal suction rolls, in particular suction rolls of small diameters (D≅800 mm), are, however, in this connection, not as favorable as the "VAC-ROLL"™ rolls for the reasons discussed above. In the positions of the reversing cylinders 11, it is also possible to use grooved reversing rolls with no through perforations, for example the grooved rolls marketed by the assignee with the trademark "UNO-ROLL".

In a preferred embodiment of the invention, the support contact between the web W and the drying wire 15 is also kept adequate on the straight runs between the drying cylinders 10 and the reversing cylinders 11, at least on the runs from the drying cylinders 10 to the reversing cylinders 11, by employing blow-suction boxes 17. By means of suction boxes 17, formation of pressures induced by the wire 15 is prevented in the closing wedge-shaped nip spaces between the wire 15 and the cylinder 11 mantles. With respect to the details of the constructions of these blow-suction boxes 17, which are marketed by the assignee under the trademark "UNO RUN BLOW BOX"™, reference is made to the assignee's Finnish Patents Nos. 59,637, 65,460 and 80,491 (corresponding to the assignee's U.S. Pat. Nos. 4,441,263, 4,516,330 and 4,905,380, respectively, the specification of which are hereby incorporated by reference herein). After the introduction of the "UNO RUN BLOW BOX"™ others have also suggested some alternative constructions of blow boxes, with respect to which reference is made to U.S. Pat. Nos. 4,502,231 (assigned to J. M. Voith GmbH) and 4,661,198 (assigned to Beloit Corp.). The applications of these blow boxes in the positions of the blow boxes 17 is also included in the scope of the overall concept of the present invention.

In the groups $R_1, \ldots, R_N$ with single-wire draw, if necessary, blow boxes 16 can also be used in the gaps between the reversing cylinders 11, by means of which boxes the intermediate spaces are air-conditioned and evaporation from the web W is promoted. The faces of the drying cylinders 10 are kept clean by doctors 14, in connection with which, if necessary, blow means are arranged which aid the tail threading of the web and by whose means blowings P are blown to ahead of the doctor blade as well as onto the face of the reversing cylinder.

In the invention, it is an important feature and advantage that broke removal by the force of gravity can be applied in the groups $R_1, \ldots, R_N$ with single-wire draw, which extend over the major part of the overall length L of the dryer section, for the groups $R_1, \ldots, R_N$ with single-wire draw are open toward the bottom so that the paper web that becomes broke can be removed without any particular arrangements onto the broke conveyor (not shown) placed in the basement space of the paper machine.

As shown in FIGS. 1–4, the paper web $W_{out}$ is passed from the dryer section to a measurement unit 30 and to a size press 40 and from there further to the finishing-dryer unit.

In the normal groups $R_1, \ldots, R_{N-1}$, the web W has time to reach a certain, quite high dry solids content of $k_1$ equals about 65% to about 85%, depending on the paper grade. In the case of newsprint preferably $k_1$ equals from about 72% to about 77%. At this dry solids content $k_1$, the web W is so strong that, for its further drying, it is possible to apply twin-wire draw without a risk of detrimental breaks. Thus, it is an important feature of the invention that, in the final end of the dryer section, preferably as the second to last, or penultimate, or last wire group, there is one single hybrid dryer group $R_H$. This hybrid group $R_H$ includes a portion with single-wire draw which is connected to a portion with twin-wire draw so that a portion of the group comprises two horizontal rows of contact-drying cylinders 20A and 20B, one row placed above the other. In connection with the upper cylinders 20A, there is an upper wire 25A which is guided by wire guide rolls 21A arranged in the gaps between the cylinders 20A (in the twin-wire portion) and by other guide rolls 28. The web W is pressed into a drying contact against the heated faces of the lower cylinders 20B by means of the lower wire 25B, which is guided by the wire guide rolls 21B arranged in the gaps between the cylinders 20B and by other guide rolls 28. In the twin-wire portion of the hybrid group $R_H$, the web W is dried from both sides providing symmetric drying. In the single-wire draw portion, there is at least one drying cylinders 20A and at least one reversing roll 11".

In FIGS. 1–4, in the twin-wire portion of the hybrid group $R_H$, a draw arrangement marketed by the assignee under the trademark "TWIN-RUN"™ is used, in which the guide rolls 21A and 21B are placed so that the drying wires 25A and 25B accompany the web from the drying cylinders 20A and 20B substantially onto the next one so that the free draws $W_0$ of the web W can be made shorter, as compared with free draws of full length. In this draw arrangement, at the proximity of the wire guide rolls 21A and 21B and at the inlet side of the web W and the drying wire 25A and 25B, air-blow boxes 22A,22B are used. Out of the blow boxes 22A,22B, which are used in the "TWIN-RUN"™ concept and which are arranged in the gaps between the drying cylinders 20A,20B, air jets of suitable direction and blow velocity are applied to the vicinity of the runs of the drying wires 25A,25B placed at their proximity and to the vicinity of the free sectors of the wire guide rolls 21A,21B. By means of these jets, the support contact between the drying wires 25A,25B and the web W is promoted, formation of detrimental differences in pressure and fluttering of the web W on the free draws $W_0$ are prevented. The blowings can also be applied through the drying wires 25A,25B, whereby it is possible to promote the ventilation of the pocket spaces formed in the gaps between the drying cylinders 20A,20B.

With respect to the further details of the "TWIN-RUN"™ concept and of the blow boxes 22A,22B, reference is made to the assignee's Finnish Pat. No. 80,103 (corresponding to DE Patent No. 3,818,600).

In connection with the drying cylinders 20A,20B, there are doctors 24, in connection with which it is possible to arrange blow means (not shown) so as to produce blowings that aid the web tail threading.

In the exemplifying embodiment of the invention shown in FIG. 1, the last group in the dryer section is a hybrid group $R_H$ in accordance with the invention. From the second to last group in the dryer section, i.e. from the last conventional group $R_N$ with single-wire draw, the paper web W is passed from the last drying cylinder 10 of the group $R_N$ as a closed draw, on support of the wire 25A, onto the first reversing cylinder 11" in the hybrid group $R_H$, from which cylinder the web W runs as a single-wire draw and guided by the reversing cylinders 11" and by the drying cylinders 20A. After two drying cylinders 20A placed in the upper row (the single-wire portion), the web W is passed to the portion with twin-wire draw in the group $R_H$, in which portion three drying cylinders 20B are placed in the lower row, which cylinders 20B have a lower wire 25B of their own. After this, the web W is passed over the drying cylinders 20A placed in the upper row and over the drying cylinders 20B placed in the lower row, as twin-wire draw, being supported by the upper and the lower wire 25A and 25B, to the end of the group $R_H$. In the twin-wire portion, the web W has free draws $W_0$ on the runs between the upper and the lower cylinders 20A,20B. At the end of the group $R_H$, the paper tail cutter device 50, which is placed in the vicinity of the last lower cylinder 20B, is illustrated schematically. As shown in FIG. 1, in order to accommodate the space of the drying cylinders, the upper cylinders 20A in the group $R_H$ are raised by a measure $H_3$, compared with the height of the cylinders in the preceding groups $R_1, \ldots, R_N$, which measure $H_3$ is from about 0 mm to about 2000 mm, preferably 400 mm to about 800 mm. The first reversing cylinder 11' in the hybrid group $R_H$ has been raised by a measure $H_4$ which is from about 0 mm to about 1000 mm, preferably 200 mm to about 600 mm, compared with the reversing cylinders in the preceding groups $R_1, \ldots, R_N$, and the next reversing cylinder 11" has been raised further, compared with said cylinder 11', by the measure $H_5$ which is from about 0 mm to about 1000 mm, preferably 200 to about 600 mm.

Figure 2:
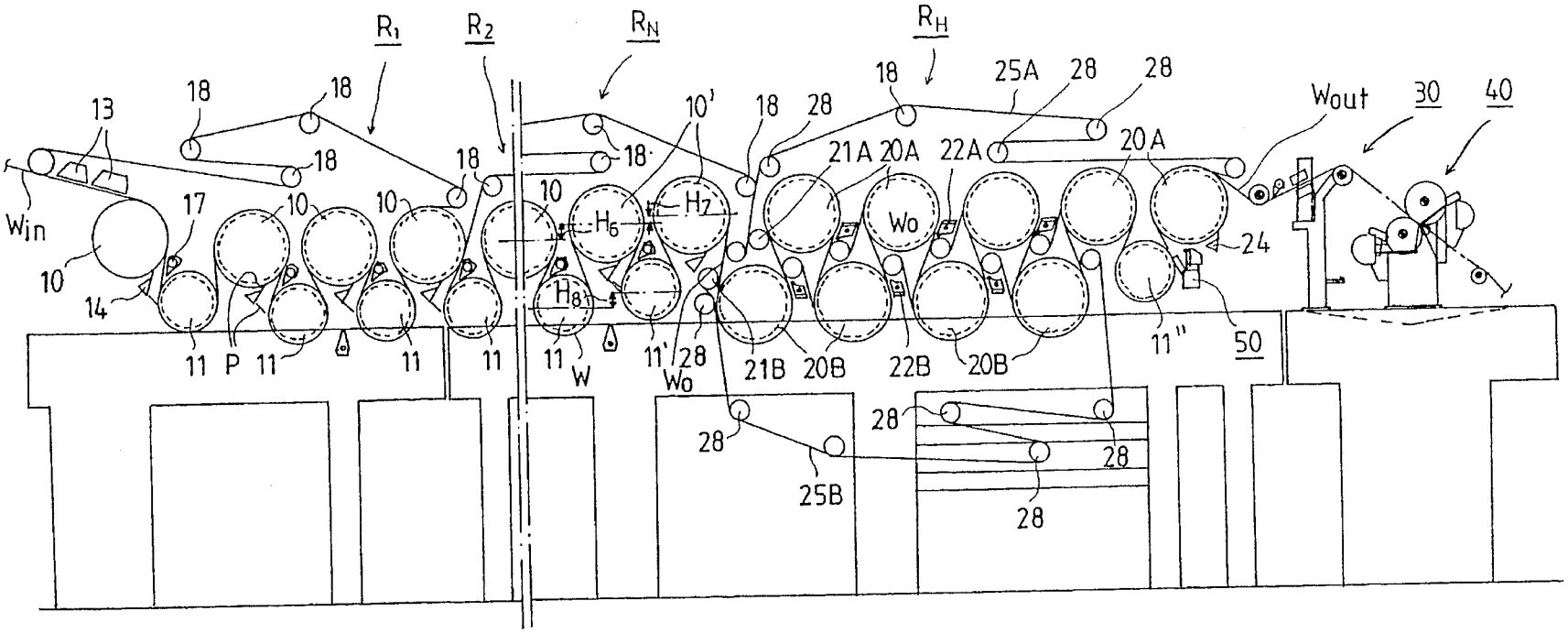
FIG. 2 is a side view of a second exemplifying embodiment of the dryer section in accordance with the invention that makes use of the method of the invention.

In the exemplifying embodiment of the invention shown in FIG. 2, the last group in the dryer section is a hybrid group $R_H$ in accordance with the invention. In this exemplifying embodiment of the invention, the portion with twin-wire draw is placed right at the beginning of the group $R_H$, in which case, when the web W arrives from the last conventional single-wire group $R_N$, it is passed from the last drying cylinder 10' onto the first lower drying cylinder 20B as an open draw $W_0$, after which the web W runs as twin-wire draw supported by the upper and the lower wire 25A and 25B, over four pairs of cylinders 20A,20B. Thereafter, in the final end of the group $R_H$, there is a portion with single-wire draw in which the reversing cylinder 11' is placed in the lower row. The tail cutter device 50 is placed at the vicinity of the last reversing cylinder 11'. In the portion with twin-wire draw, between the upper and lower rows of cylinders, the web W has free draws $W_0$. In order to accommodate the space of the drying cylinders, the last two cylinders 10' in the last group $R_N$ with single-wire draw have been raised from the level of the preceding drying cylinders 10. The second to last cylinder 10' has been raised by the measure $H_6$ which is from about 0 mm to about 1000 mm, preferably 200 mm to about 600 mm, and the last cylinder by the measure $H_7$ which is from about 0 mm to about 1000 mm, preferably 200 mm to about 600 mm. The reversing cylinder placed between these last two drying cylinders 10' has been raised by the measure $H_8$ which is from about 0 mm to about 1000 mm, preferably 200 mm to about 600 mm. The upper cylinders 20A in the hybrid group are placed on the same level as the last drying cylinder 10' in the preceding group $R_N$.

Figure 3:
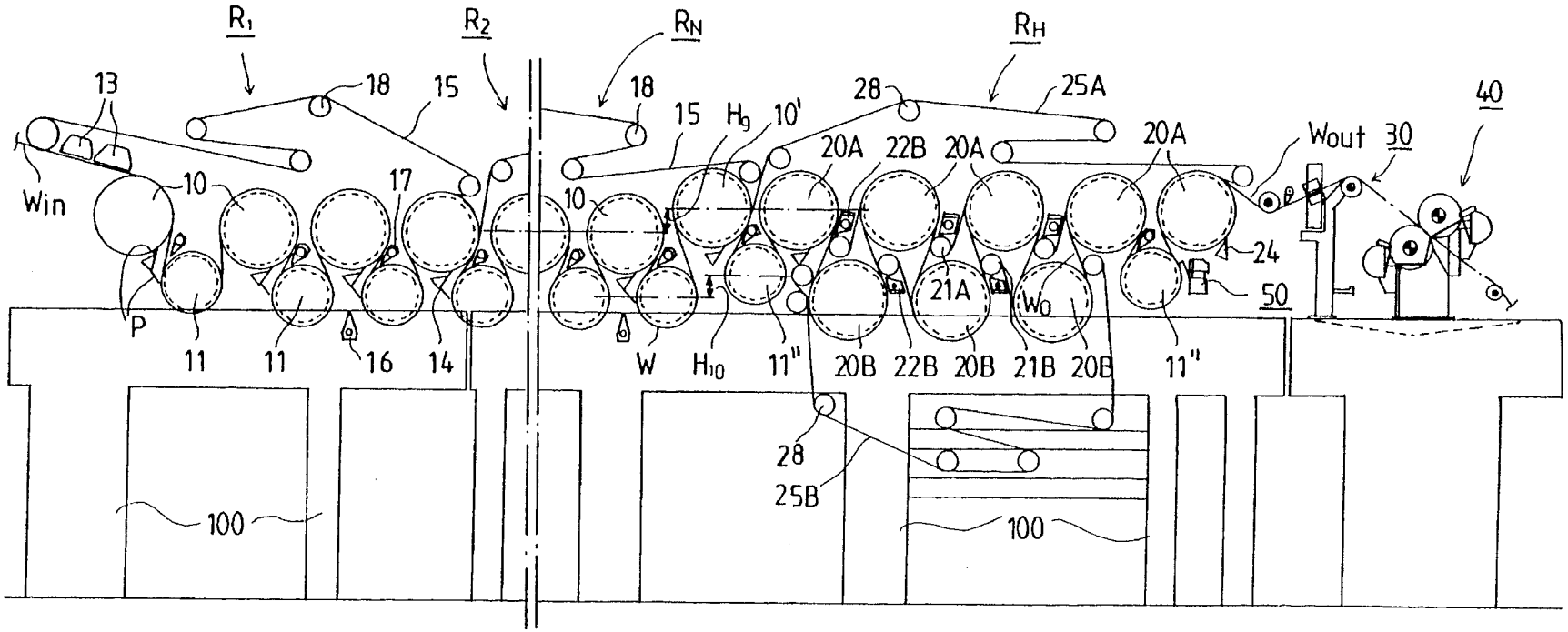
FIG. 3 is a side view of a third exemplifying embodiment of the dryer section in accordance with the invention that makes use of the method of the invention.

In the hybrid group $R_H$ in accordance with the invention shown in FIG. 3, the portion with twin-wire draw is placed in a middle area of the group $R_H$ so that, when the web arrives in the dryer group $R_H$, the web W runs over one reversing cylinder 11" onto the drying cylinder 20A in the upper row, after which a portion with twin-wire draw consisting of three pairs of cylinders 20A,20B starts. Thereafter, the group $R_H$ ends in a portion with single-wire draw. In order to accommodate the requirement of space of the dryer group, the last cylinder 10' in the preceding group $R_N$ has been raised by the measure $H_9$ which is from about 0 mm to about 1000 mm, preferably 200 mm to about 600 mm. The upper cylinders in the hybrid group $R_H$ are on the same level with the last cylinder 10' and the reversing rolls 11" have been raised by the measure H10 which is from about 0 mm to about 1000 mm, preferably 200 mm to about 600 mm, compared with the reversing rolls 11 in the preceding groups $R_1, \ldots, R_N$.

Figure 4:
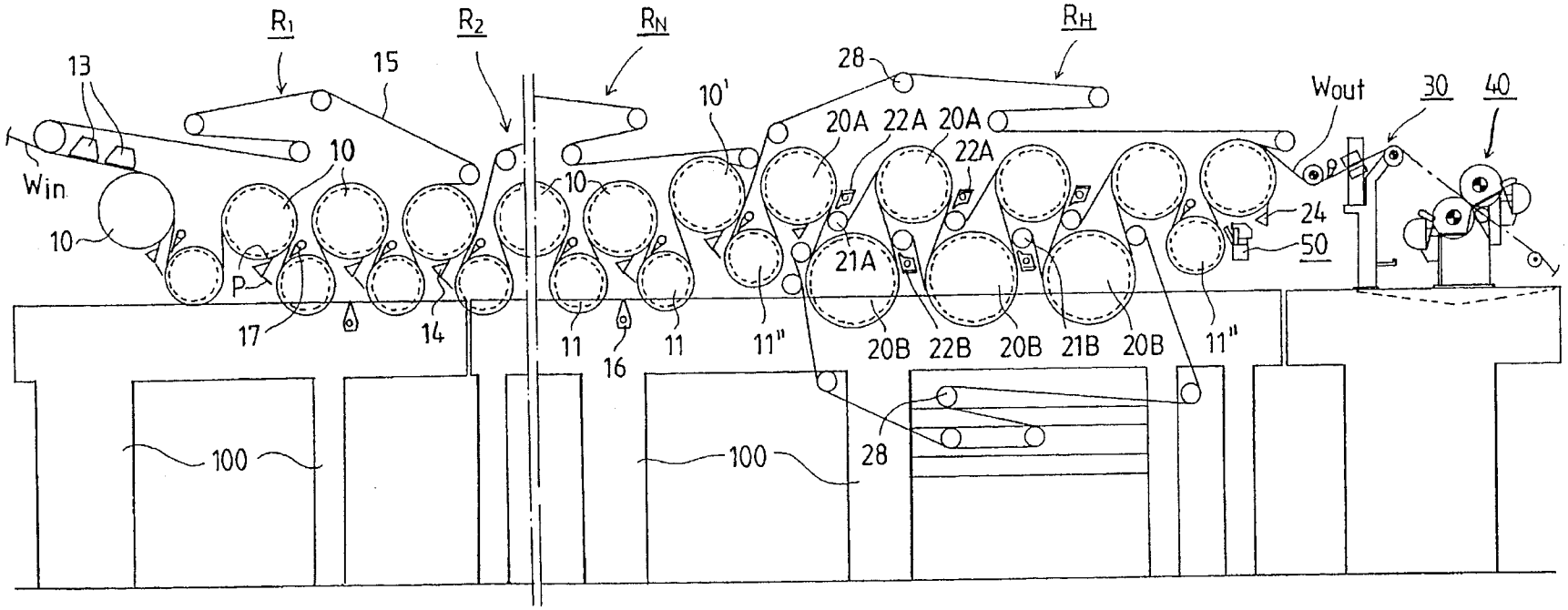
FIG. 4 is a side view of a fourth exemplifying embodiment of the dryer section in accordance with the invention that makes use of the method of the invention.

In respect of the location of the portion with twin-wire draw, the hybrid group $R_H$ shown in FIG. 4 corresponds to that shown in FIG. 3. In the exemplifying embodiment of the invention shown in FIG. 4, the drying cylinders 20B in the lower row in the portion with twin-wire draw are large-diameter drying cylinders which are larger than the diameter of the other drying cylinders 20A in the hybrid group $R_H$. The diameter D of cylinders 20B is from about 1500 mm to about 3000 mm, preferably 2200 mm to about 2500 mm.

Figure 5:
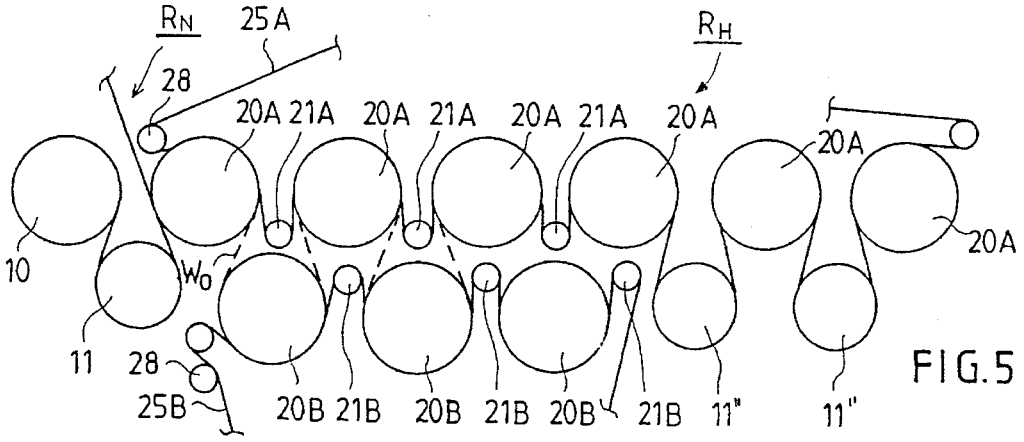
FIGS. 5, 6 and 7 are illustrations of further exemplifying embodiments of dryer groups of dryer sections in accordance with the invention that make use of the method of the invention.
Figure 6:
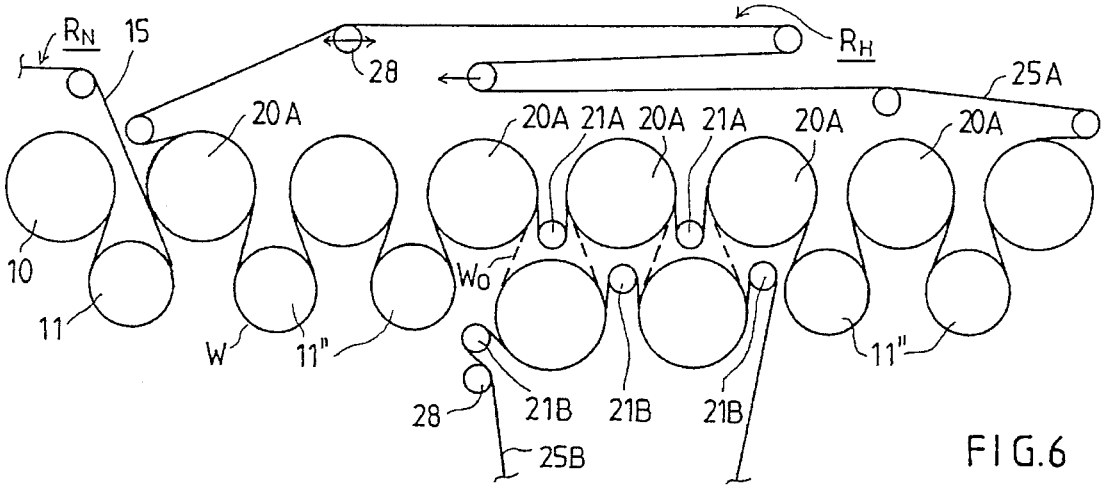
Figure 7:
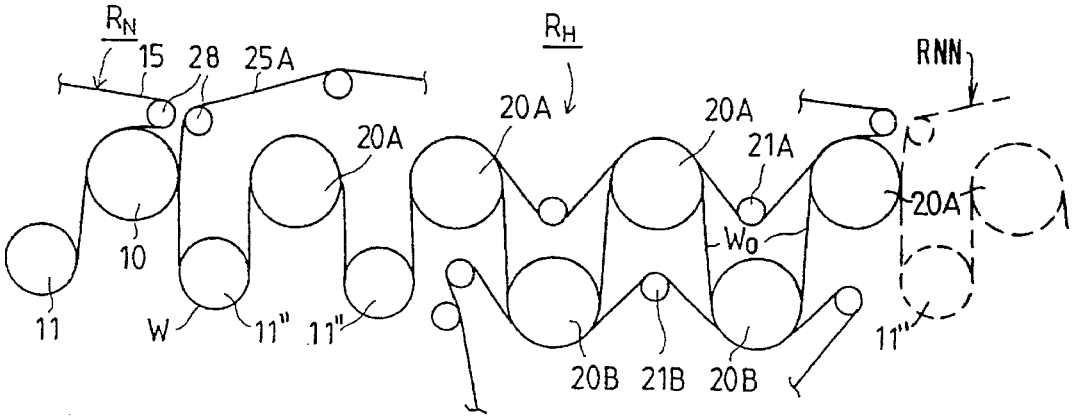

In the hybrid dryer groups $R_H$ in accordance with the invention shown in FIGS. 5–7, the "TWIN-RUN"™ arrangement described above is not used in the portion with twin-wire draw, but the guide rolls 21A,21B of the wires 25A,25B are placed as interlocked in the gaps between the drying cylinders 20A,20B, i.e., substantially equidistant between the adjacent drying cylinders whereby the wire does not accompany the web substantially from one drying cylinder to the following drying cylinders. In this case, the open draw $W_0$of the paper web W becomes longer. In respect of the other principles, the exemplifying embodiments as shown in FIGS. 5–7 correspond to the arrangements illustrated in more detail above in FIGS. 1–4.

In FIG. 5, the portion with twin-wire draw starts from the beginning of the group $R_H$ where the paper web W arriving from the preceding group $R_N$ is passed directly onto the drying cylinder 20A in the upper row. Thereafter, the web is passed onto the drying cylinder 20B in the lower row. At the end of the group $R_H$, there is a portion with single-wire draw. The twin-wire portion comprises three pairs of cylinders 20A,20B.

In the arrangement shown in FIG. 6, the portion with twin-wire draw is placed around the middle of the group $R_H$. The portion with twin-wire draw of the hybrid group $R_H$ comprises two pairs of cylinders 20A,20B. In the beginning and end of the group $R_H$, there are portions with single-wire draw.

In the exemplifying embodiment shown in FIG. 7, the hybrid dryer group $R_H$ is similar to the exemplifying embodiment shown in FIG. 5, with the difference that the portion with single-wire draw is placed in the beginning of the group $R_H$.

In addition, the hybrid group may be the penultimate dryer group in the dryer section in which case an additional dryer group $R_{NN}$ would follow the hybrid group in the running direction of the web. Such an additional group $R_{NN}$, a single-wire draw group, is shown in phantom lines in FIG. 7 and the web is dried to its final dry solids content in this additional group.

In the preferred embodiment of the invention, the hybrid group $R_H$ is placed as the last drying group in the dryer section. The hybrid group $R_H$ is also suitable for use as some other group in the sequence in the dryer section, preferably, however, as one of the last drying groups. Thus, the hybrid groups described above may be used in any dryer section and may be used alone if desired.

In the arrangements in accordance with the invention, as regulation parameters, it is possible to use the tension of the wires 25A,25B and the steam pressure in the drying cylinders 20A,20B. The steam pressures in the upper and lower cylinders can be regulated separately, and, if necessary, even the steam pressure of each cylinder can be regulated separately. In a hybrid group in accordance with the invention, in the area of twin-wire draw, as the lower wire 25B, it is suitable to use a wire whose permeability is higher than the permeability of the wires 15 used in the area with single-wire draw, i.e. of the upper wire 25A.

In a preferred embodiment of the invention, the tension $T_A$ of the wire 25A is in the range of from about 1.5 to about 5.0 kN/m, and the tension $T_B$ of the wire 25B is in the range of from about 1.5 to about 5.0 kN. The wire tensions $T_A$ and $T_B$ of the upper and the lower wire 25A and 25B can be equal or different, compared with one another, depending on the requirements of drying of the web W. Such an embodiment is particularly advantageous in which the tension $T_B$ of the wire 25B of the lower cylinders 20B is higher than the tension $T_A$ of the upper wire 25A. By means of this selection, the symmetry of drying is promoted by drying the top side of the web W to a greater extent. In the area of single-wire draw, in the groups $R_1, \ldots, R_N$, the tension $T_N$ of the wires 15 is in the range of from about 1.5 to about 5.0 kN/m.

The symmetry of drying can be promoted further by using different steam pressures and cylinder-face temperatures in the upper cylinders 20A as compared with the lower cylinders 20B. Preferably, in the lower cylinders 20B, a higher steam pressure and a higher cylinder temperature are used than in the upper cylinders 20A. This, together with the difference in tension $T_B > T_A$ between the wires 25A and 25B, promotes the symmetry of drying of the web W by, in the hybrid group $R_H$, drying the top face of the web W to a greater extent than the bottom face, whose drying proportion was in the normal groups $R_1, \ldots, R_N$ higher than the drying of the top face, owing to the cylinders 10.

Further, the symmetry of drying can be regulated by choosing the permeabilities of the upper and the lower wire 25A and 25B different from one another.

In the exemplifying embodiments shown in FIGS. 1, 3, 4 and 7, the draw of the web between the group with single-wire draw and the following hybrid dryer group is a closed draw, which has been arranged so that the drying wire 25A of the hybrid group has a contact or turning sector with the last drying cylinder in the preceding group $R_N$ with single-wire draw.

In the exemplifying embodiments shown in FIGS. 5 and 6, there is also a closed draw between the group with single-wire draw and the following hybrid dryer group $R_H$, which has been arranged so that the drying wire 15 of the preceding wire group $R_N$ has a contact or turning sector with the first drying cylinder 20A in the following hybrid group $R_N$.

In the exemplifying embodiment shown in FIG. 2, an open draw has been used.

In the hybrid groups in accordance with the invention, a drive group with single-wire draw has been combined with twin-wire draw over a portion of the group. Besides the exemplifying embodiments shown in the figures, of course, the relative location of height of the hybrid group $R_H$ can be different in relation to the rest of the dryer section. For example, the level of the hybrid group in the vertical direction may also be lower than that of the other drying groups (cf. FIG. 1). Further, the scope of the invention includes exemplifying embodiments in which, in the portion with single-wire draw placed in the end of the group $R_H$, there may be several reversing cylinders 11' for example 1–3 cylinders (cf. FIG. 2). Also, the arrangement in accordance with the invention can also be modified, for example, so that all the upper cylinders in the portion with twin-wire draw are placed on the same level with one another. The scope of the invention also includes a modification in which the upper cylinders in the portion with twin-wire draw in the hybrid group are placed on a level different from the level of the upper cylinders in the single-wire portion in the hybrid group.

In a particular embodiment of the invention, the dryer section comprises between 3 and 10 normal groups, each having between 4 and 8 drying cylinders, and the hybrid group has between 3 and 14 drying cylinders. More specifically, the dryer section may have between 5 and 7 normal groups, each having between 5 and 7 drying cylinders, and the hybrid group may have between 5 and 10 drying cylinders.

The examples provided above are not meant to be exclusive. Many other variations of the present invention would be obvious to those skilled in the art, and are contemplated to be within the scope of the appended claims.

We claim:

1. A method for contact drying a paper web in a dryer section including a plurality of successively arranged normal groups with single-wire draw, each of said normal groups including heated smooth-faced drying cylinders situated in a row, reversing suction cylinders or reversing suction rolls situated in another row spaced from said row of drying cylinders, and a drying wire for pressing the paper web into contact with said drying cylinders and for carrying the paper web between said drying cylinders and said reversing suction cylinders or rolls, the method comprising the steps of:

drying the paper web to substantially a first dry solids content by passing the web through said plurality of successively arranged normal groups with single-wire draw, and thereafter drying the paper web to substantially a second dry solids content by passing the web through a hybrid group including a single-wire draw portion and a twin-wire draw portion, said single-wire draw portion including heated smooth-faced drying cylinders situated in a first row, reversing suction cylinders or rolls situated in a second row spaced from said first row, and a drying wire for pressing the paper web into contact with said drying cylinders and for carrying the paper web between said drying cylinders and said reversing suction cylinders or rolls, said twin-wire draw portion including drying cylinders arranged in said first row and a second row, wire guide rolls arranged between adjacent ones of said drying cylinders in each of said first and second rows, and first and second drying wires for pressing the web against the surfaces of said drying cylinders in a respective row, said first drying wire of said twin-wire draw portion constituting the drying wire in said single-wire draw portion.

2. The method of claim 1, further comprising the step of drying the web to its final dry solids content in said hybrid group.

3. The method of claim 1, further comprising the step of drying the web to its final dry solids content by passing the web from said hybrid group to a normal group with single-wire draw.

4. The method of claim 1, further comprising the step of preventing pressure differences that interfere with the support contact of the paper web on runs of the drying wires between said drying cylinders and said reversing cylinders or rolls by means of blow boxes.

5. The method of claim 1, further comprising the step of relaxing the web in free draws between said first and second rows of drying cylinders in said twin-wire draw portion.

6. The method of claim 1, wherein portion of the paper web becomes broke in the groups with single-wire draw, further comprising the step of removing the paper web that becomes broke from the groups with single-wire draw which are open downward substantially by the force of gravity onto a broke conveyor.

7. The method of claim 1, further comprising the step of;

providing a closed draw between one of said normal groups with single-wire draw adjacent to said hybrid group and said hybrid group by separating the web from a last one of said drying cylinders in said one of said normal groups adjacent to said hybrid group and transferring the web onto a face of one of said drying wires in said hybrid group by providing said one of said drying wires of said hybrid group with a contact or turning sector with said last drying cylinder in said normal group adjacent to said hybrid group.

8. The method of claim 1, further comprising the step of providing an open draw between one of said normal groups with single-wire draw adjacent to said hybrid group and said hybrid group.

9. The method of claim 1, wherein said hybrid group includes free draws of the paper web, further comprising the steps of;

promoting support contact between the drying wires in said hybrid group and the paper web, reducing fluttering of the free draws of the paper web in said hybrid group, and promoting ventilation of closed pocket spaces that remain in gaps between said drying cylinders in said hybrid group by arranging blow boxes in said pocket spaces between adjacent ones of said drying cylinders and proximate to wire guide rolls placed in said pocket spaces.

10. The method of claim 1, further comprising the step of promoting symmetry of the drying of the paper web in the dryer section by employing a higher wire tension of said drying wires in said hybrid group than the wire tension employed in said normal groups with single-wire draw preceding said hybrid group in the running direction of the web.

11. The method of claim 1, further comprising the step of;

promoting the symmetry of drying of the paper web in said hybrid group by employing different wire tensions in said first and second drying wires such that in said hybrid group, the proportion of the drying of an upper face of the paper web which is carried out on said drying cylinders in said first row is greater than the corresponding drying proportion on said drying cylinders in said second row.

12. The method of claim 1, further comprising the step of applying ropeless tail threading by generating pressure differences and directing air blowings to guide the web.

13. The method of claim 1, further comprising the step of:

providing a closed draw between one of said normal groups with single-wire draw adjacent to said hybrid group and said hybrid group by separating the web from the drying wire in said normal group adjacent to said hybrid group and transferring the web onto a face of a first one of said drying cylinders in said hybrid group by providing the drying wire of said normal group adjacent to said hybrid group with a contact or turning sector with said first drying cylinder in said hybrid group.

14. The method of claim 1, further comprising the step of:

promoting the symmetry of drying of the paper web in said hybrid group by providing said drying cylinders in said first row with a different steam pressure than said drying cylinders in said second row, such that in said hybrid group, the proportion of the drying of an upper face of the paper web which is carried out on said drying cylinders in said first row is greater than the corresponding drying proportion on said drying cylinders in said second row.

15. The method of claim 1, further comprising the step of:

promoting the symmetry of drying of the paper web in said hybrid group by using different permeabilities of said first and second drying wires such that in said hybrid group, the proportion of the drying of an upper face of the paper web which is carried out on said drying cylinders in said first row is greater than the corresponding drying proportion on said drying cylinders in said second row.

16. The method of claim 1, further comprising the step of:

promoting the symmetry of drying of the paper web in said hybrid group by providing said drying cylinders in said first row with a different diameter than said drying cylinders in said second row, such that in said hybrid group, the proportion of the drying of an upper face of the paper web which is carried out on said drying cylinders in said first row is greater than the corresponding drying proportion on said drying cylinders in said second row.

17. A dryer section of a paper machine for drying a paper web, comprising a plurality of successively arranged normal groups with single-wire draw, each of said normal groups including drying cylinders arranged in one row, reversing rolls arranged in another row spaced from said row of said drying cylinders, and a drying wire for carrying the web between said drying cylinders and said reversing rolls, and a hybrid dryer group arranged after said plurality of normal groups in a running direction of the web, said hybrid dryer group comprising a single-wire draw portion including heated smooth-faced drying cylinders situated in a first row, reversing rolls, and a first drying wire for pressing the web into contact with said drying cylinders and carrying the web between said drying cylinders and said reversing rolls, and a twin-wire draw portion including drying cylinders arranged in said first row and a second row, wire guide rolls arranged between adjacent ones of said drying cylinders in each of said first and second rows, and a second drying wire for pressing the web against said drying cylinders in said second row, said first drying wire also forming a part of said twin-wire draw portion and pressing the web against said drying cylinders in said first row of said twin-wire draw portion.

18. The dryer section of claim 17, further comprising air-blow means for enhancing support contact between said drying wires in said normal groups and the web, said air-blow means being arranged on joint runs of said drying wires and the web from said drying cylinders to said reversing rolls.

19. The dryer section of claim 17, wherein the paper web has free unsupported draws in said twin-wire draw portion between said first row of said drying cylinders and said second row of said drying cylinders.

20. The dryer section of claim 17, comprising between 3 and 10 of said normal groups, each of said groups having between 4 and 8 of said drying cylinders, and said hybrid group having between 3 and 14 of said drying cylinders.

21. The dryer section of claim 17, comprising between 5 and 7 of said normal groups, each of said groups having between 5 and 7 of said drying cylinders, and said hybrid group having between 5 and 10 of said drying cylinders.

22. The dryer section of claim 17, further comprising means arranged in connection with the dryer section for producing pressure differences in order to aid in guiding of the web through the dryer section.

23. The dryer section of claim 17, wherein said hybrid group includes free draws of the paper web, further comprising air-blow boxes arranged in said hybrid group in spaces between adjacent ones of said drying cylinders, said air-blow boxes applying blowings to said first and second drying wires in said hybrid group in order to promote mutual support contact between said drying wires and the paper web, reduce fluttering of the free draws of the paper web, and promote ventilation of closed pocket spaces defined in gaps between said drying cylinders.

24. The dryer section of claim 17, wherein said hybrid group is the last drying group in the dryer section.

25. The dryer section of claim 17, wherein said hybrid group is the penultimate drying group in the dryer section.

26. The dryer section of claim 17, further comprising means arranged in connection with the dryer section for guiding air-blows for ropeless tail threading in order to aid in guiding a tail of the web through the dryer section.

27. A hybrid dryer group in a dryer section of a paper machine in which a paper web is dried, comprising a single-wire draw portion including heated smooth-faced drying cylinders situated in a first row, reversing suction rolls, and a first drying wire for pressing the web into contact with said drying cylinders and carrying the web between said drying cylinders and said reversing rolls, said suction rolls being structured and arranged to apply negative pressure to the web through said drying wire to draw water from the web into said suction rolls, a twin-wire draw portion including drying cylinders arranged in said first row and a second row, wire guide rolls arranged between adjacent ones of said drying cylinders in each of said first and second rows, and a second drying wire for pressing the web against said drying cylinders in said second row, said first drying wire also forming a part of said twin-wire draw portion and pressing the web against said drying cylinders in said first row of said twin-wire draw portion.

* * * * *